US005603378A

United States Patent [19]

Alford

[11] Patent Number: 5,603,378

[45] Date of Patent: Feb. 18, 1997

[54] WELL CLEANING TOOL

[76] Inventor: George Alford, 1954 Old Daytona Rd., Daytona Beach, Fla. 32014

[21] Appl. No.: 556,743

[22] Filed: Nov. 2, 1995

[51] Int. Cl.[6] ..... E21B 37/00

[52] U.S. Cl. ..... 166/222; 166/191

[58] Field of Search ..... 166/222, 223, 166/312, 202, 170, 171, 173, 191, 185, 186

[56] References Cited

U.S. PATENT DOCUMENTS

| | | | |
|---|---|---|---|
| 1,260,241 | 3/1918 | Minton | 166/171 |
| 1,379,815 | 5/1921 | Hall | 166/222 X |
| 2,136,881 | 11/1938 | Johnson | 166/191 |
| 2,186,309 | 1/1940 | Travis | 166/223 X |
| 3,089,544 | 5/1963 | Cobb | 166/312 X |
| 3,547,191 | 12/1970 | Malott | 166/223 |
| 4,609,045 | 9/1986 | Rogers | 166/312 |
| 4,763,728 | 8/1988 | Lacey | 166/191 |
| 4,899,821 | 2/1990 | Casida | 166/312 |

*Primary Examiner*—Hoang C. Dang
*Attorney, Agent, or Firm*—James B. Middleton

[57] ABSTRACT

A well cleaning tool includes a surge block, and a jetting tool or nozzle carried by the surge block. The surge block has fluid passageways therein for supplying the jetting nozzle. The surge block is formed of a cylindrical central body with elastomeric disks fixed above and below the central body, the disks being sized to fit relatively snugly within the well casing. The fluid passageway through the central body is threaded at the top for connection of a supply conduit, and may be threaded at the bottom for connection of a jetting nozzle. Thus, the jetting tool can be used for initial cleaning, while the surge block confines the heat and chemical action; then, the surge block can be reciprocated for surging the well. Both surging and jetting can be used simultaneously, and/or alternatively. A plurality of disks can be used as desired, and a jetting nozzle can be outside the disks, or between two disks to confine the chemical action.

2 Claims, 2 Drawing Sheets

WELL CLEANING TOOL

BACKGROUND OF THE INVENTION

1. Field of the Invention

This invention relates generally to well cleaning or opening methods and apparatus, and is more particularly concerned with a combination surging and jetting method and apparatus.

2. Discussion of the Prior Art

It is common for wells of various types to become clogged, so cleaning is necessary for the well to continue to function. Also, when wells are first drilled, the surrounding area may be naturally clogged enough to retard or prevent fluid flow. Sometimes the clog in the well is due to corrosion, accumulation of inorganic materials or the like, and sometimes the clog in the well is due to growth of bacterial colonies. The latter is discussed in more detail in U.S. Pat. No. 4,765,410, and that disclosure is incorporated herein by this reference.

The method disclosed in the above mentioned patent utilizes a jet for some cleaning of the well screen and of the interior of the well casing, then relies on a circulation of heated solution, and perhaps some pressure, for thorough cleaning of the well screen and the gravel pack.

Another common technique for use in cleaning wells is surging, in which a surge block substantially fills the well casing, and is reciprocated within the well casing to cause a reciprocating fluid flow. This fluid flow assists in breaking loose clogging material, and can force chemicals used out into the aquifer.

When both jetting and surging are to be used on the same well, one tool has been inserted and used, then that tool removed from the well and the other tool inserted into the well for use. Repetitions of the treatments required repetitions of the removal and re-insertion which requires much time and labor.

SUMMARY OF THE INVENTION

The present invention provides a combination surge block and jetting tool, the jetting tool being carried by the surge block. The surge block defines fluid passages therethrough for delivering fluid to the jetting tool. The jetting tool is preferably substantially centered with respect to the surge block so the surge block holds the jetting tool generally centered with respect to the well casing and well screen.

Conduit means connect to the top side of the surge block and communicate with the passages therein. The conduit may also be the holding and control means for the surge block, or an additional cable or the like may be used.

Thus, in accordance with the method of the present invention, one can quickly alternate between jetting and surging, and can use both jetting and surging simultaneously so the surging currents include the chemicals supplied by jetting.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
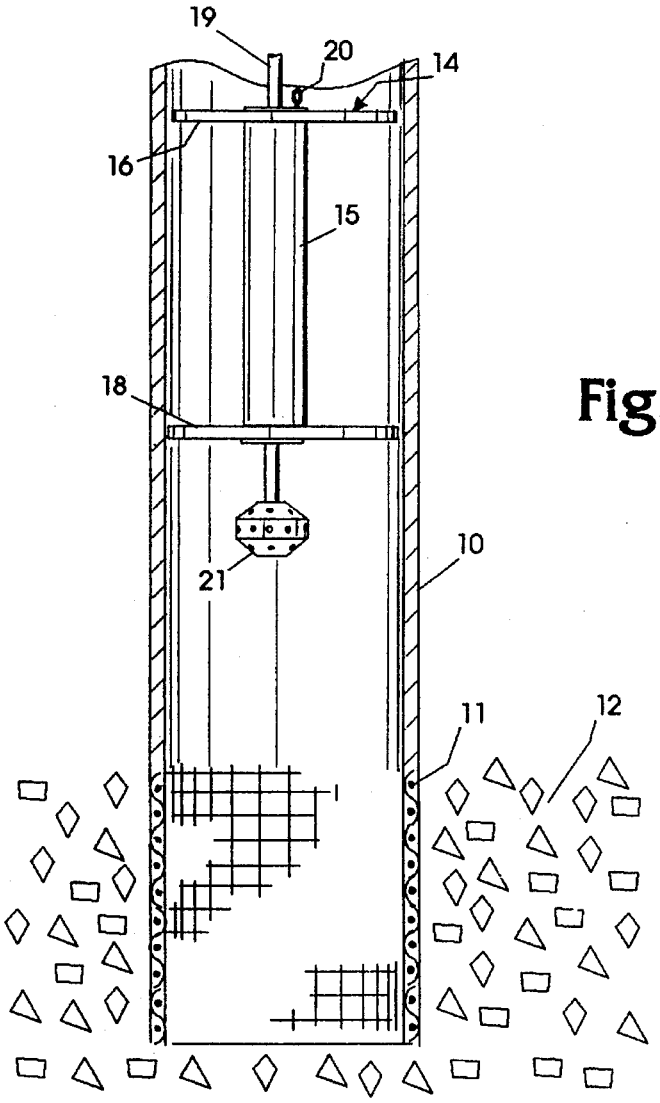
FIG. 1 is an elevational view showing a tool made in accordance with the present invention, the tool being within a well which is shown in cross-section.

Referring now more particularly to the drawings, and to those embodiments of the invention here presented by way of illustration, FIG. 1 shows a well casing 10 having a well screen 11 at the lower end thereof. As is conventional, the well screen 11 has a gravel pack therearound as indicated at 12. When a well becomes clogged, the well screen 11 may be clogged and/or the gravel pack 12 may be so clogged as to be substantially non-porous.

The basic techniques in cleaning a well include the introduction of chemicals to break up the clogging material in order to promote free flow, spraying the interior of the well casing and screen with chemicals under high pressure, and surging to cause reciprocating currents for mechanically loosening clogging material.

The apparatus of the present invention includes a surge block generally designated at 14, the surge block 14 being shown as disposed within the well casing 10. The surge block includes a central body 15 having upper and lower disks 16 and 18 fixed thereto. The disks 16 and 18 substantially fill the well casing 10, so the action of moving the surge block 14 within the well casing is similar to the action of moving a piston within a cylinder. The disks 16 and 18 are preferably somewhat flexible, and this will be discussed in more detail hereinafter.

The top end of the surge block has a conduit 19 fixed thereto. The conduit may simply deliver fluid, or may also act as the means for moving the surge block. Also, when desired, an eye 20 may be fixed to the surge block 14, the eye 20 receiving a cable or the like for controlling movement of the surge block 14.

The lower end of the surge block 14 carries a jetting tool generally designated at 21. The purpose of the jetting tool 21 is to direct a cleaning fluid against the interior of the well casing, and the well screen, to loosen or remove clogging material. It is important to notice that the nozzle of the jetting tool 21 is significantly smaller than the diameter of the well casing 10. When the jetting tool 21 is in the vicinity of the well screen 11, jets of liquid ought not to be discharged directly through a hole in the screen 11. The high pressure fluid passing directly into the gravel pack 12 will disturb the gravel pack, and will place a substantial amount of chemicals into the aquifer.

Thus, in the device of the present invention, the jetting tool has a small diameter relative to the diameter of the well casing 10. The fluid is introduced at high pressure, and the fluid becomes dispersed before reaching the well screen.

Figure 2:
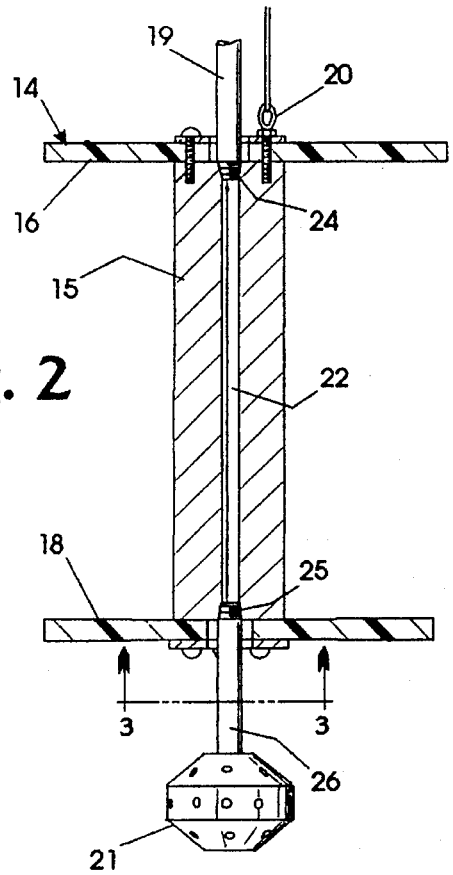
FIG. 2 is an enlarged diametrical cross-sectional view of the tool shown in FIG. 1.

Looking at FIG. 2 of the drawings, it can be seen that the central body 15 of the surge block 14 is generally cylindrical, and defines a fluid passage 22 axially therethrough. The upper end of the passage 22 is threaded at 24, and the lower end of the passage 22 is threaded at 25. The threads 24 and 25 are here shown as tapered pipe threads, but those skilled in the art will understand that a conventional machine thread may be used if desired. However, if standard pipe is used as the conduit 19 and the connection 26 for the jetting tool 21, the pipe threads may be preferred.

The disks 16 and 18 are preferably flexible enough to allow the disks to bend under reasonably large forces. The purpose is not to damage the well casing or screen, and to provide relief in the event the surge block is moved too fast to allow the water to move at the same rate. Many different materials can be used, preferably of a rubbery consistency. The disks may be formed of natural or synthetic rubber, or from any of the thermoplastic elastomers such as polyolefins, nylons, polytetraflouroethylene, polyurethane and the like. The disks 16 and 18 must be stiff enough to effect movement of water in the well, so of course the thickness of the material will vary with the size of the well.

Figure 3:
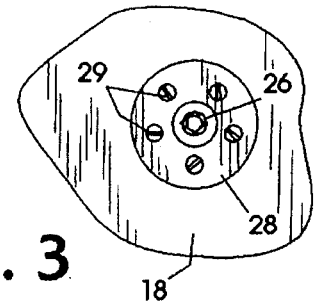
FIG. 3 is a fragmentary view taken along the line 3—3 in FIG. 2; and, FIG. 4 is a view similar to FIG. 2 but showing a modified form of the tool.

The body 15 of the surge block 14 will be made of a very durable material, such as stainless steel. Thus, the body 15 will be substantially permanent, while the disks 16 and 18 will be somewhat expendable. To hold the disks in place, and to render them easily changeable, the disk (for example, disk 18) is placed against the lower end of the body 15. A rigid plate 28 is placed over the disk 18, and a plurality of screws 29 is passed through the plate 28, through the disk 18, and into threaded holes in the body 15. This is well shown in FIGS. 2 and 3 of the drawings.

The disk 16 is similarly fixed to the top of the body 15. The only difference is that one of the screws 29 may be replaced by the screw eye 20. Obviously, the eye 20 may be provided in other ways, but use of a screw eye in place of one of the screws 29 is efficient and effective.

With the above discussion in mind, operation of the apparatus of the present invention should be understandable. When a well is to be cleaned, the tool of the present invention can be lowered into the well casing as shown in FIG. 1 of the drawings. As a preliminary step, the jetting tool 21 may be used to spray a chemical mix against the well screen for partially breaking up the clog on the screen. The jetting tool 21 will have openings such that fluid emitted therefrom will be dispersed, so there will a considerable amount of turbulence. This turbulent flow of fluid will cause significant agitation and cleaning of the well screen.

After the well screen has been at least partially cleaned, the tool of the present invention can be moved up and down to cause a surging action in the well. The reciprocating flow of the water will mechanically loosen further clogging material. It is also possible that the chemical introduced through the jetting tool 21 may assist in loosening the clog; therefore, one might introduce additional fluid during the surging so both the surging and jetting are utilized simultaneously.

Figure 4:
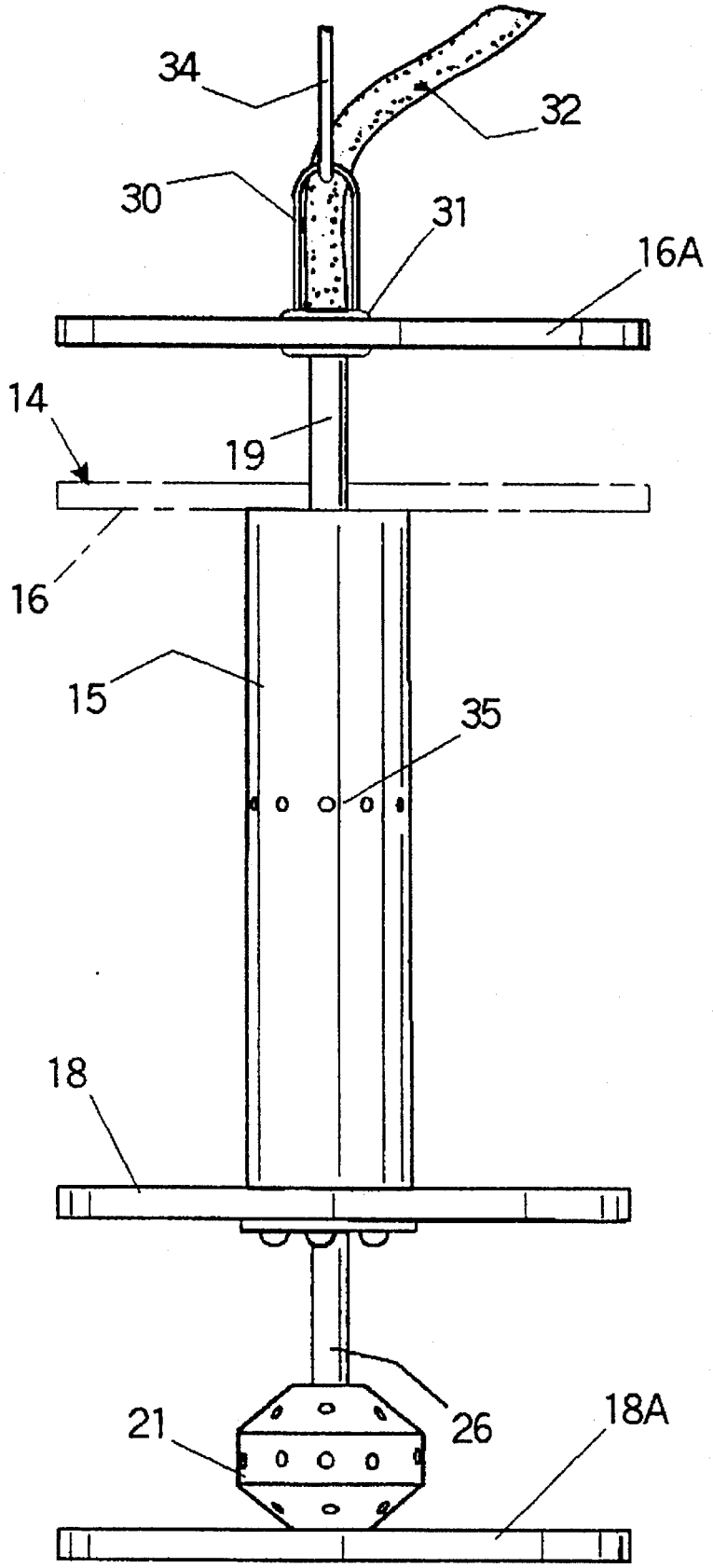

Attention is next directed to FIG. 4 of the drawings for a discussion of some modifications of the invention. FIG. 4 illustrates several structural modifications of the well cleaning tool, but those skilled in the art will realize that any particular modifications may be used as needed for any particular well, with no requirement to adopt all the changes shown.

First, it is an existing practice to use more than two disks, such as the disks 16 and 18, on a surge block. While it is convenient to fix the disks 16 and 18 to the ends of the block 15, it will be understood that such disks may be fixed elsewhere. For example, a disk 16A may be fixed to the rigid conduit 19. Such disk may replace the disk 16 as is shown in full lines, or may be in addition to the disk 16 as is shown in phantom. Furthermore, a disk 18A may be added below the disk 18. As here illustrated, the disk 18A is carried by the jetting tool 21, but the disk may of course be fixed to the conduit 26, on either side of the jetting tool 21.

Those skilled in the art will understand that any number of disks may be used; and, the disks can be more or less flexible as described, and smaller or larger relative to the size of the well casing. These are variables that are routinely dealt with by those skilled in the art, and no further discussion is thought to be necessary.

It was previously mentioned that some structure other than the screw eye 20 can be used to support the surge block of the present invention. One alternative is shown in FIG. 4 where it will be seen that a bail 30 is fixed to a fitting 31. As here shown, the fitting 31 is received on the rigid conduit 19, and allows connection of a flexible hose 32. This same fitting is here shown as receiving the disk 16A, though it will be recognized that different mechanical devices may be used for the various functions if desired. It will be well understood that the control cable 34 may be fixed to the cleaning tool in many different ways, and the arrangements here shown are merely by way of illustration.

FIGS. 1 and 2 of the drawings show the jetting tool extending from the bottom of the cleaning tool for general use. There are times, however, when one may wish to confine the action of the jetting tool; and, the device of the present invention allows such confinement by selectively placing the jetting tool between two of the disks, such as the disks 16 and 18. For example, as shown in FIG. 4 the jetting tool 21 is below the disk 18, but above the disk 18A, so the tool 21 is confined between the two disks. As a result, the discharged fluid, and the turbulent action of the fluid, will be substantially confined between the two disks for a localized action.

Another means for achieving the confined jetting action is to provide jetting nozzles within the body 15 of the tool. FIG. 4 illustrates a plurality of radially-extending holes 35 in the body 15. Such holes will communicate with the central passage 22, and direct fluid outwardly, but confined between the disks 16 and 18, or the disks 16A and 18, or otherwise as desired.

As is stated above, it is generally preferable to provide a diverse fluid stream from the nozzle 21 or 35 since the usual intent is to clean the casing, well screen or the like. There are situations, however, wherein a more narrowly defined jet is useful. In wells wherein the well is drilled into a natural rock formation, and there is no artificial gravel pack, but simply naturally occurring rock appropriately fractured to allow the flow of liquid, it may be necessary to force fluid into the pores, or fractures, in the rock. For this purpose, the holes, the nozzle 21 or 35 may be closer to the well screen, and/or may be differently formed to provide a narrow jet of fluid.

With the above described structural modifications in mind, it will be understood that the apparatus of the present invention can be quite versatile. In addition to treating and cleaning wells having the gravel pack, the more narrowly confined jets can be used to drill out pores or fractures in a natural rock well, or fractured aquifer. Such wells are also referred to as a "open hole" or "rock" wells. Such cleaning, or drill-out, can be done with an open nozzle such as the jetting tool 21 shown in FIG. 1, or the nozzle can be confined between two disks as shown in FIG. 4.

In addition to cleaning old wells that have become fouled, the method and apparatus of the present invention can be used to develop new wells. Again, if the fracture, or pores, in rock must be cleaned or opened, the jetting action provided by the present apparatus can be used. The nozzle can be open, or confined; and, the jetting can be used either alone or in combination with surging.

While certain combinations are here illustrated, it will be understood that the various structures can be used alone, or in any combination deemed useful for the given problem.

The specific structural arrangements herein illustrated and described are merely suggestive.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A well cleaning tool, for use in a well comprising a well casing, and a well screen at the lower end of said well casing, said well cleaning tool comprising a surge block receivable within said well casing and having an upper end and a lower end, said surge block defining a fluid passageway therethrough extending from said upper end to said lower end, conduit means communicating with said fluid passageway at said upper end of said surge block, and jetting means carried by said surge block and communicating with said fluid passageway, said surge block comprising a central body defining said fluid passageway, an upper disk fixed with respect to said central body adjacent to said upper end of said surge block, and a lower disk fixed with respect to said central body adjacent to said lower end of said surge block, said disks having a diameter slightly less than the diameter of said well casing, said disks being formed of a rubber selected from the group consisting of natural rubbers, synthetic rubbers and thermoplastic elastomers, and wherein said upper disk is fixed to said central body, and further including an upper plate received against said upper disk, and a plurality of fastening means extending through said upper plate, said upper disk, and into said central body for fixing said upper disk to said central body.

2. A well cleaning tool as claimed in claim 1, wherein said lower disk is fixed to said central body, and including a lower plate received against said lower disk, and a plurality of fastening means extending through said lower plate, said lower disk, and into said central body for fixing said lower disk to said central body.

* * * * *